US011682835B2

(12) United States Patent
Kuo et al.

(10) Patent No.: US 11,682,835 B2
(45) Date of Patent: Jun. 20, 2023

(54) ACTIVE PHASED ARRAY

(71) Applicant: Au Optronics Corporation, Hsinchu (TW)

(72) Inventors: Chia-Wei Kuo, Hsinchu (TW); Yi-Yang Liao, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/392,276

(22) Filed: Aug. 3, 2021

(65) Prior Publication Data

US 2022/0271426 A1 Aug. 25, 2022

(30) Foreign Application Priority Data

Feb. 24, 2021 (TW) ..... 110106508

(51) Int. Cl.
*H01Q 21/00* (2006.01)
*H01Q 3/36* (2006.01)

(52) U.S. Cl.
CPC ..... *H01Q 3/36* (2013.01)

(58) Field of Classification Search
CPC ..... H01Q 3/36; H01Q 3/30
See application file for complete search history.

(56) References Cited

U.S. PATENT DOCUMENTS 6,933,907 B2 * 8/2005 Shirasaka ..... H01Q 3/36 343/810
10,320,089 B2 6/2019 Jakoby et al.
10,886,623 B2 * 1/2021 Son ..... H04B 1/40
2013/0207741 A1 * 8/2013 Presti ..... H03H 7/48 333/111
2014/0015719 A1 * 1/2014 Ramachandran ..... H01Q 1/243 343/745
2014/0266897 A1 * 9/2014 Jakoby ..... H01Q 3/44 29/601
2019/0260139 A1 8/2019 Jakoby et al.
2020/0059005 A1 2/2020 Wu et al.
2020/0343634 A1 10/2020 Wang et al.
2021/0066772 A1 * 3/2021 Wu ..... H01Q 3/36
2021/0210851 A1 7/2021 Wu et al.

FOREIGN PATENT DOCUMENTS

| | | |
|---|---|---|
| CN | 103975483 | 8/2014 |
| CN | 109921190 | 6/2019 |
| CN | 110350310 | 10/2019 |
| TW | 201409956 | 3/2014 |
| WO | 2020015449 | 1/2020 |

* cited by examiner

*Primary Examiner* — Awat M Salih
(74) *Attorney, Agent, or Firm* — JCIPRNET

(57) ABSTRACT

An active phased array, including multiple antennas, multiple phase shifters, and multiple filters, is provided. The phase shifters are individually coupled to a corresponding one of the antennas. The filters are commonly coupled to a signal feeding line and individually coupled to a corresponding one of the phase shifters. Each filter includes a filter capacitor and a filter resistor. The filter capacitor is coupled between a first node and a second node and has a capacitance. The filter resistor is coupled between the second node and a third node and has a resistance. The first node is coupled to one of the signal feeding line, the second node is coupled to a corresponding one of the phase shifters, the third node is coupled to the ground, and at least one of the capacitance and the resistance is adjustable.

6 Claims, 8 Drawing Sheets

ACTIVE PHASED ARRAY

CROSS-REFERENCE TO RELATED APPLICATION

This application claims the priority benefit of Taiwan application serial no. 110106508, filed on Feb. 24, 2021. The entirety of the above-mentioned patent application is hereby incorporated by reference herein and made a part of this specification.

BACKGROUND

Technical Field

The disclosure relates to a phased array, and particularly relates to an active phased array.

Description of Related Art

At present, the frequency band of the fifth generation (5G) communication system may be divided into two types: "sub-6 gigahertz (GHz)" that is below 6 GHz and high-frequency bands (that is, millimeter waves) at 26/28 GHz. The millimeter wave (mmWave) frequency band improves channel efficiency and system performance through adopting beamforming protocols of phased array transmitters and receivers to provide a data rate of up to 7 gigabits per second (7 Gbit/s) and assist the user in aligning the transmission path.

The phased array is divided into the passive phased array and the active phased array. The antenna unit of the passive phased array only changes the signal phase without the ability to switch the signal. The antenna unit of the active phased array has the abilities to change the signal phase and switch the signal, and since each antenna unit may be independently used as a signal source to actively emit electromagnetic waves, the active phased array has a wider range of communication applications and is the mainstream trend of array antenna development.

SUMMARY

The disclosure provides an active phased array, which has a filter with adjustable cut-off frequency, so as to control the number of antennas that transmit signals.

The active phased array of the disclosure includes multiple antennas, multiple phase shifters, and multiple filters. The phase shifters are individually coupled to a corresponding one of the antennas. The filters are commonly coupled to a signal feeding line and individually coupled to a corresponding one of the phase shifters. Each filter includes a filter capacitor and a filter resistor. The filter capacitor is coupled between a first node and a second node and has a capacitance. The filter resistor is coupled between the second node and a third node and has a resistance. The first node is coupled to one of the signal feeding line and a ground, the second node is coupled to a corresponding one of the phase shifters, the third node is coupled to other of the signal feeding line and the ground, and at least one of the capacitance and the resistance is adjustable.

Based on the above, in the active phased array of the embodiments of the disclosure, the filter is composed of the filter capacitor and the filter resistor, and at least one of the capacitance of the filter capacitor and the resistance of the filter resistor is adjustable. In this way, the cut-off frequency of the filter will move with the adjusted capacitance and/or resistance, so that the filter is conducted or cut off relative to a carrier frequency of an antenna signal transmitted by the signal feeding line.

In order for the features and advantages of the disclosure to be more comprehensible, the following specific embodiments are described in detail in conjunction with the accompanying drawings.

DETAILED DESCRIPTION OF DISCLOSED EMBODIMENTS

Unless otherwise defined, all terms (including technical and scientific terms) used herein have the same meaning as commonly understood by persons skilled in the art to which the disclosure belongs. It will be further understood that terms such as those defined in commonly used dictionaries should be interpreted as having meanings consistent with the meanings in the related technologies and the context of the disclosure, and will not be interpreted as having idealized or overly formal meanings, unless explicitly defined as such herein.

It should be understood that although terms such as "first", "second", and "third" may be used herein to describe various elements, components, regions, layers, and/or parts, the elements, components, regions, layers, and/or parts should not be limited by the terms. The terms are only used to distinguish one element, component, region, layer, or part from another element, component, region, layer, or part. Therefore, a "first element", "component", "region", "layer", or "part" discussed below may be referred to as a second element, component, region, layer, or part without departing from the teachings herein.

The terms used here are only for the purpose of describing specific embodiments and are not restrictive. As used herein, unless the content clearly indicates otherwise, the singular forms "a", "one", and "the" are intended to include the plural forms, which include "at least one", "or", and "and/or". As used herein, the term "and/or" includes any and all combinations of one or more items related to the listed item. It should also be understood that when used in the specification, the terms "include" and/or "comprise" designate the presence of a feature, a region, a whole, a step, an operation, an element, and/or a component, but do not exclude the presence or addition of one or more other features, regions, wholes, steps, operations, elements, components, and/or combinations thereof.

Figure 1A:
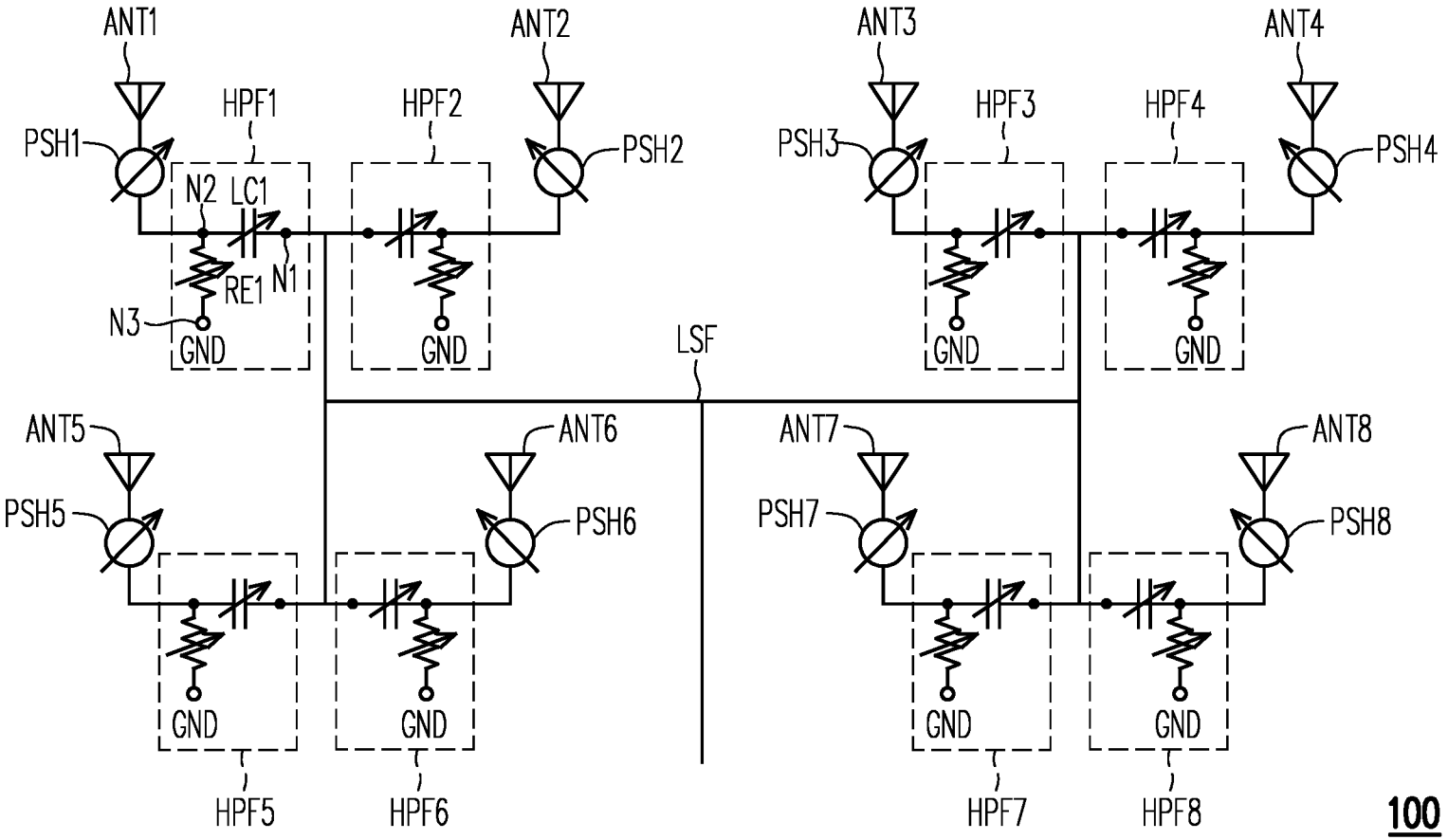
FIG. 1A is a schematic diagram of a system of an active phased array according to a first embodiment of the disclosure.

FIG. 1A is a schematic diagram of a system of an active phased array according to a first embodiment of the disclosure. Please refer to FIG. 1A. In the embodiment, an active phased array 100 includes multiple antennas (such as ANT1 to ANT8), multiple phase shifters (such as PSH1 to PSH8), and multiple filters (exemplified using high-pass filters HPF1 to HPF8 here). The number of antennas, phase shifters, and filters may be set to be the same, but the embodiment of the disclosure is not limited thereto.

The phase shifters PSH1 to PSH8 are individually coupled to a corresponding one of the antennas ANT1 to ANT8. For example, the phase shifter PSH1 is coupled to the antenna ANT1, the phase shifter PSH2 is coupled to the antenna ANT2, and the rest may be deduced by analogy. The high-pass filters HPF1-HPF8 are commonly coupled to a signal feeding line LSF and individually coupled to a corresponding one of the phase shifters PSH1 to PSH8. For example, the high-pass filter HPF1 is coupled to the phase shifter PSH1, the high-pass filter HPF2 is coupled to the phase shifter PSH2, and the rest may be deduced by analogy. In other words, the phase shifter PSH1 and the high-pass filter HPF1 are coupled in series between the antenna ANT1 and the signal feeding line LSF, the phase shifter PSH2 and the high-pass filter HPF2 are coupled in series between the antenna ANT2 and the signal feeding line LSF, and the rest may be deduced by analogy.

Each of the high-pass filters HPF1 to HPF8 includes a filter capacitor LC1 and a filter resistor RE1. The filter capacitor LC1 is coupled between a first node N1 and a second node N2 and has a capacitance. The filter resistor RE1 is coupled between the second node N2 and a third node N3 and has a resistance. The first node N1 is coupled to the signal feeding line LSF, the second node N2 is coupled to a corresponding one of the phase shifters PSH1 to PSH8, the third node N3 is coupled to a ground GND, and at least one of the capacitance and the resistance is adjustable. As a result, the cut-off frequency of the high-pass filters HPF1 to HPF8 will move with the adjusted capacitance and/or resistance, so that the high-pass filters HPF1 to HPF8 are conducted or cut off relative to a carrier frequency of an antenna signal transmitted by the signal feeding line LSF. In addition, by adjusting the capacitance and the resistance of a part of the high-pass filters HPF1 to HPF8, emission sources of a part of the antennas (such as ANT1 to ANT8) may be turned off to achieve a partial reception and emission function.

In the embodiment of the disclosure, the antenna may be implemented in any form, such as a dipole antenna, a monopole antenna, a patch antenna, a loop antenna, a slot antenna, a slot+patch antenna, and a liquid crystal (LC) antenna.

Figure 1B:
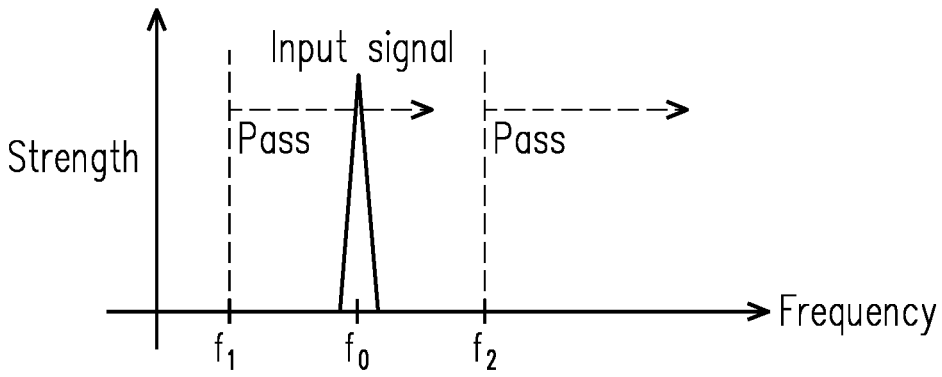
FIG. 1B is a schematic diagram of a frequency domain of a high-pass filter according to an embodiment of the disclosure.

FIG. 1B is a schematic diagram of a frequency domain of a high-pass filter according to an embodiment of the disclosure. Please refer to FIG. 1A and FIG. 1B. When setting the capacitance of the filter capacitor LC1 and/or the resistance of the filter resistor RE1 of each of the high-pass filters HPF1 to HPF8 such that the cut-off frequency (such as a cut-off frequency $f_1$) of each of the high-pass filters HPF1 to HPF8 is lower than a carrier frequency $f_0$ of the antenna signal transmitted by the signal feeding line LSF, each of the high-pass filters HPF1 to HPF8 is conducted relative to the carrier frequency $f_0$ of the antenna signal transmitted by the signal feeding line LSF. When setting the capacitance of the filter capacitor LC1 and/or the resistance of the filter resistor RE1 of each of the high-pass filters HPF1 to HPF8 such that the cut-off frequency (such as a cut-off frequency $f_2$) of each of the high-pass filters HPF1 to HPF8 is higher than the carrier frequency $f_0$, each of the high-pass filters HPF1 to HPF8 is cut off relative to the carrier frequency $f_0$ of the antenna signal transmitted by the signal feeding line LSF.

Figure 1C:
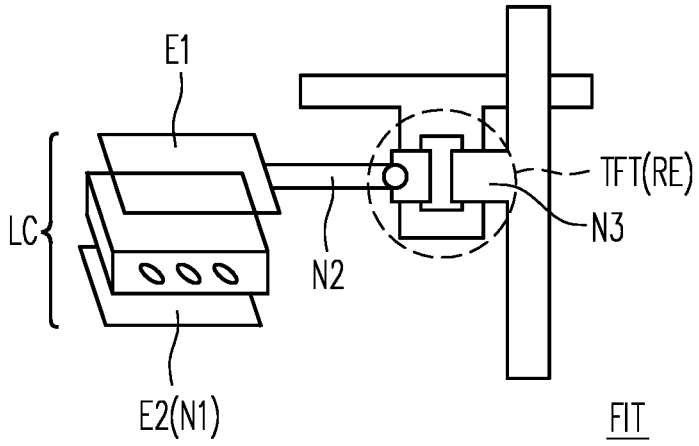
FIG. 1C is a schematic diagram of a structural domain of a high-pass filter according to an embodiment of the disclosure.

FIG. 1C is a schematic diagram of a structural domain of a high-pass filter according to an embodiment of the disclosure. Please refer to FIG. 1A to FIG. 1C. In the embodiment of the disclosure, the capacitance of a filter capacitor LC and the resistance of a filter resistor RE of a filter FIT are both adjustable. Furthermore, the filter capacitor LC may be composed of one or more liquid crystal capacitors. When adjusting the voltage difference between an upper electrode E1 and a lower electrode E2 of the liquid crystal capacitor of the filter capacitor LC, the rotation direction of the liquid crystal may be adjusted, thereby adjusting the capacitance of a liquid crystal layer. On the other hand, the filter resistor RE may include an impedance transistor TFT. When a drain-gate voltage of the impedance transistor TFT changes, an impedance of a semiconductor layer of the impedance transistor TFT also changes, so as to adjust the resistance of the filter resistor RE.

In the embodiment, the upper electrode E1 of the liquid crystal capacitor of the filter capacitor LC is coupled to a drain (that is, the node N2) of the impedance transistor TFT. The lower electrode E2 of the liquid crystal capacitor of the filter capacitor LC is equivalent to the first node N1, and a source of the impedance transistor TFT is equivalent to the third node N3. Here, "upper" and "lower" are merely illustrated in conjunction with the drawings to distinguish between different elements, but the embodiment of the disclosure is not limited thereto.

In the embodiment, the liquid crystal capacitors of the filter capacitor LC may be connected in parallel and/or in series to adjust a sum capacitance function of the filter capacitor LC, and the liquid crystal capacitors of the filter capacitor LC may be individually controlled to expand the adjustable range of the capacitance.

In other embodiments, when the capacitance of the filter capacitor LC of the filter FIT is fixed (that is, non-adjustable), the filter capacitor LC may be composed of two overlapping electrodes sandwiching one or more insulating layers. When the resistance of the filter resistor RE is fixed (that is, non-adjustable), the filter resistor RE may be composed of one or more conductive layers or one or more transistors connected in a diode type. The above are examples for illustration, but the embodiment of the disclosure is not limited thereto.

Figure 2:
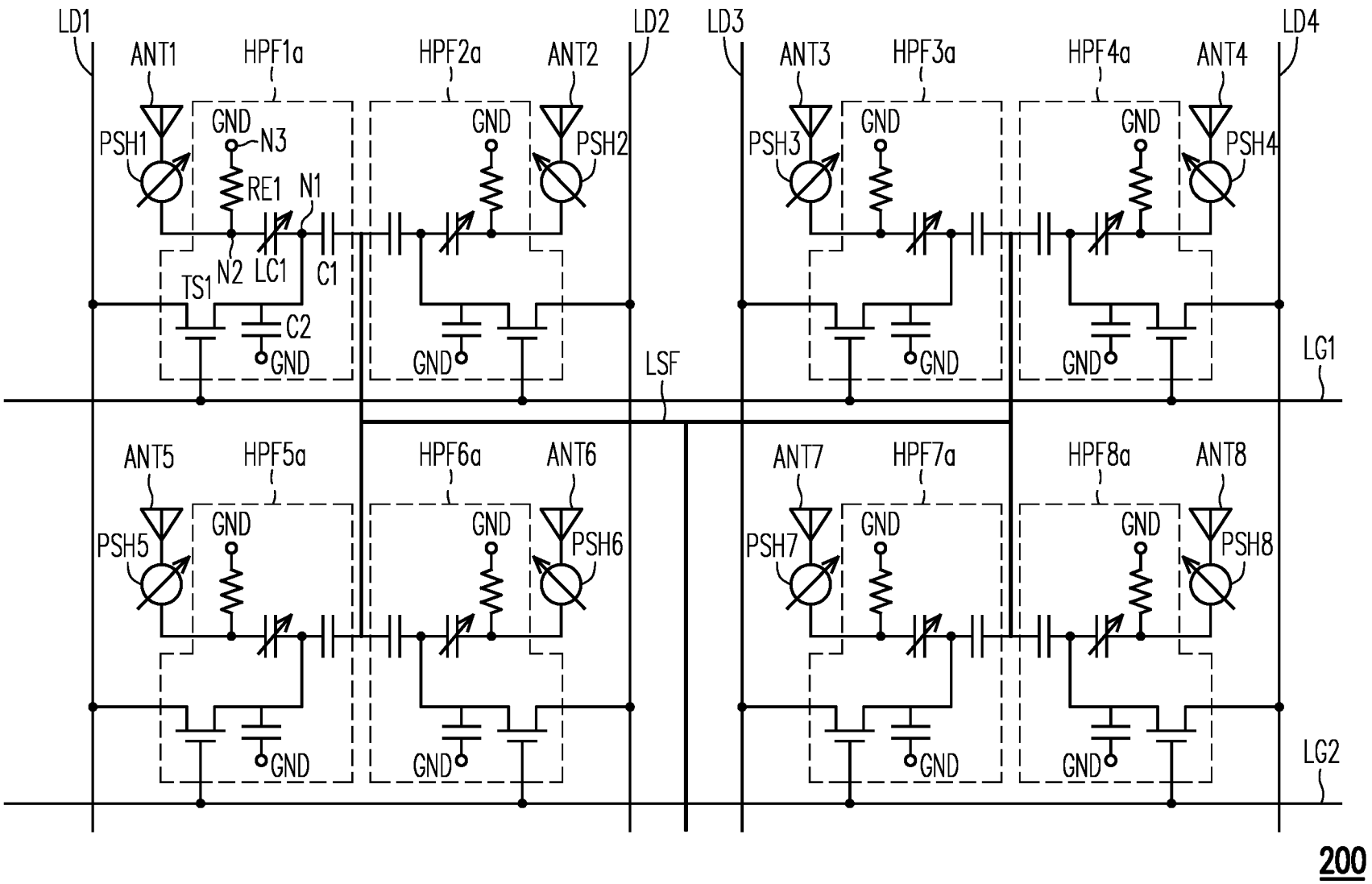
FIG. 2 is a schematic diagram of a system of an active phased array according to a second embodiment of the disclosure.

FIG. 2 is a schematic diagram of a system of an active phased array according to a second embodiment of the disclosure. Please refer to FIG. 1A and FIG. 2. In the embodiment, an active phased array 200 is roughly the same as the active phased array 100. The differences are with high-pass filters HPF1*a* to HPF8*a*, and that the active phased array 200 further includes multiple data lines (such as LD1 to LD4) and multiple gate lines (such as LG1 to LG2) to receive a signal and/or a voltage required for control. The same or similar reference numerals are used for similar or identical elements.

In the embodiment, it is assumed that the capacitance of the filter capacitor LC1 in each of the high-pass filters HPF1*a* to HPF8*a* is adjustable. Here, take the high-pass filter HPF1*a* as an example, and for the high-pass filters HPF2*a* to HPF8*a*, reference may be made to the high-pass filter HPF1*a*. In the embodiment, in addition to the filter capacitor LC1 and the filter resistor RE1, the high-pass filter HPF1*a* further includes a first capacitor C1, a first switching transistor TS1, and a second capacitor C2. The first capacitor C1 is coupled between the signal feeding line LSF and the filter capacitor LC1, and the first capacitor C1 may be formed by the signal feeding line LSF and the lower electrode E2 of the liquid crystal capacitor. The first switching transistor TS1 has a first terminal coupled to the filter capacitor LC1, a second terminal coupled to the data line LD1, and a control terminal coupled to the gate line LG1. The second capacitor C2 is coupled between the first terminal of the first switching transistor TS1 and the ground GND.

According to the above, in each of the high-pass filters HPF1*a* to HPF8*a*, the voltage difference of the second capacitor C2 determines the capacitance of the filter capacitor LC1, and the first switching transistor TS1 of each of the high-pass filters HPF1*a* to HPF8*a* may be sequentially conducted via signals of the gate lines LG1 to LG2 to sequentially set the voltage difference of the second capacitor C2 of each of the high-pass filters HPF1*a* to HPF8*a* via voltages on the data lines LD1 to LD4, so as to change the capacitance of the filter capacitor LC1 of each of the high-pass filters HPF1*a* to HPF8*a*.

Figure 3:
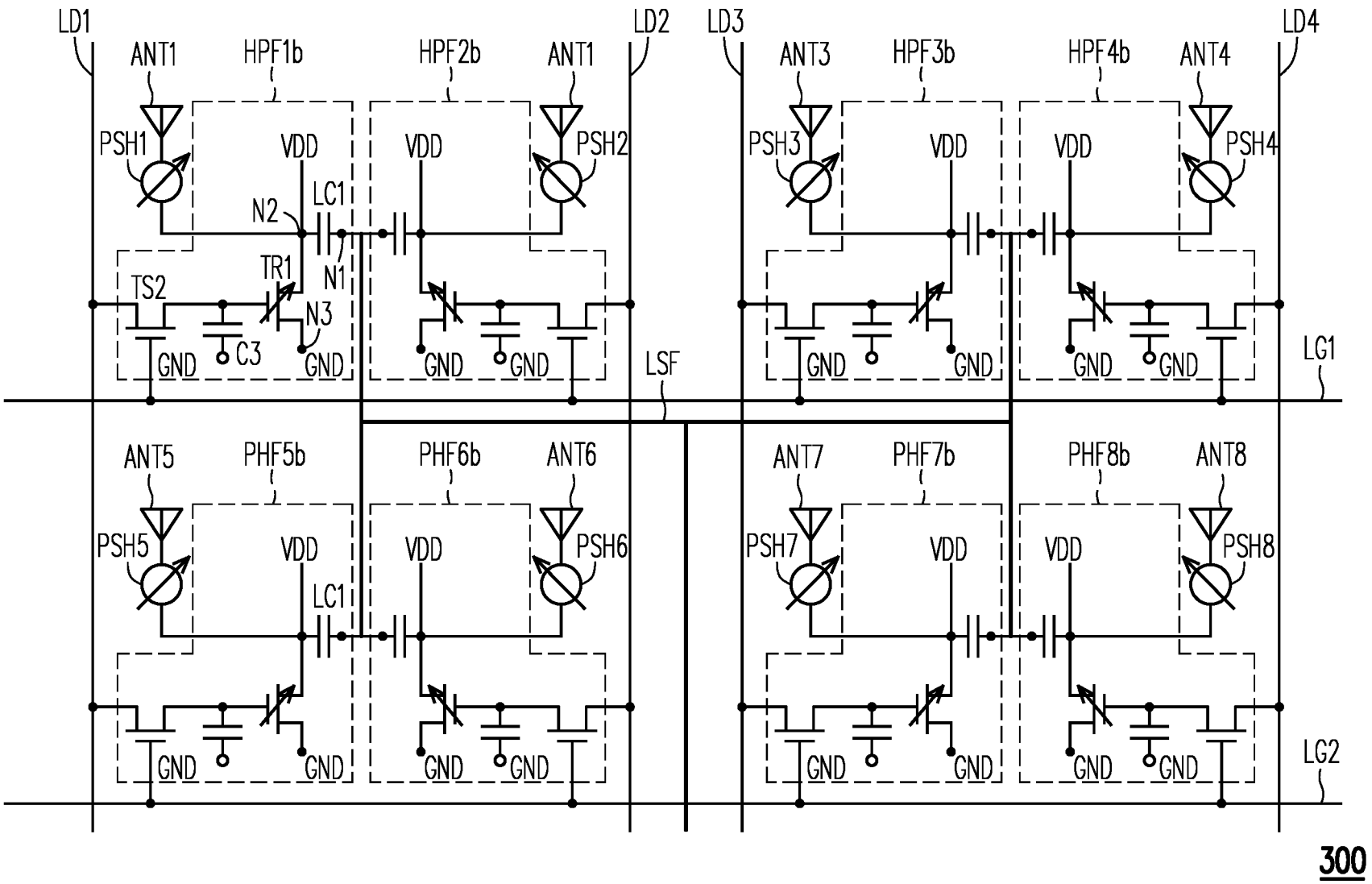
FIG. 3 is a schematic diagram of a system of an active phased array according to a third embodiment of the disclosure.

FIG. 3 is a schematic diagram of a system of an active phased array according to a third embodiment of the disclosure. Please refer to FIG. 1A and FIG. 3. In the embodiment, an active phased array 300 is roughly the same as the active phased array 100. The differences are with high-pass filters HPF1*b* to HPF8*b*, and that the active phased array 300 further includes multiple data lines (such as LD1 to LD4) and multiple gate lines (such as LG1 to LG2) to receive a signal and/or a voltage required for control. The same or similar reference numerals are used for similar or identical elements.

In the embodiment, it is assumed that the resistance of the filter resistor RE1 in each of the high-pass filters HPF1*b*-HPF8*b* is adjustable. Here, take the high-pass filter HPF1*b* as an example, and for the high-pass filters HPF2*b* to HPF8*b*, reference may be made to the high-pass filter HPF1B. In the embodiment, the filter resistor RE1 includes an impedance transistor TR1. The impedance transistor TR1 has a first terminal coupled to the phase shifter PSH1, a second terminal coupled to the ground GND, and a control terminal. In addition, the second node N2 is coupled to a system high voltage VDD.

In addition to the filter capacitor LC1 and the impedance transistor TR1, the high-pass filter HPF1*b* further includes a second switching transistor TS2 and a third capacitor C3. The second switching transistor TS2 has a first terminal coupled to the control terminal of the impedance transistor TR1, a second terminal coupled to the data line LD1, and a control terminal coupled to the gate line LG1. The third capacitor C3 is coupled between the first terminal of the second switching transistor TS2 and the ground GND.

According to the above, in each of the high-pass filters HPF1*b* to HPF8*b*, the voltage difference of the third capacitor C3 determines the resistance of the filter resistor RE1, and the second switching transistor TS2 of each of the high-pass filters HPF1*b* to HPF8*b* may be sequentially conducted via signals of the gate lines LG1 to LG2 to set the voltage difference of the third capacitor C3 of each of the high-pass filters HPF1*b* to HPF8*b* via voltages on the data lines LD1 to LD4, so as to change the resistance of the filter resistor RE1 of each of the high-pass filters HPF1*b* to HPF8*b*.

Figure 4A:
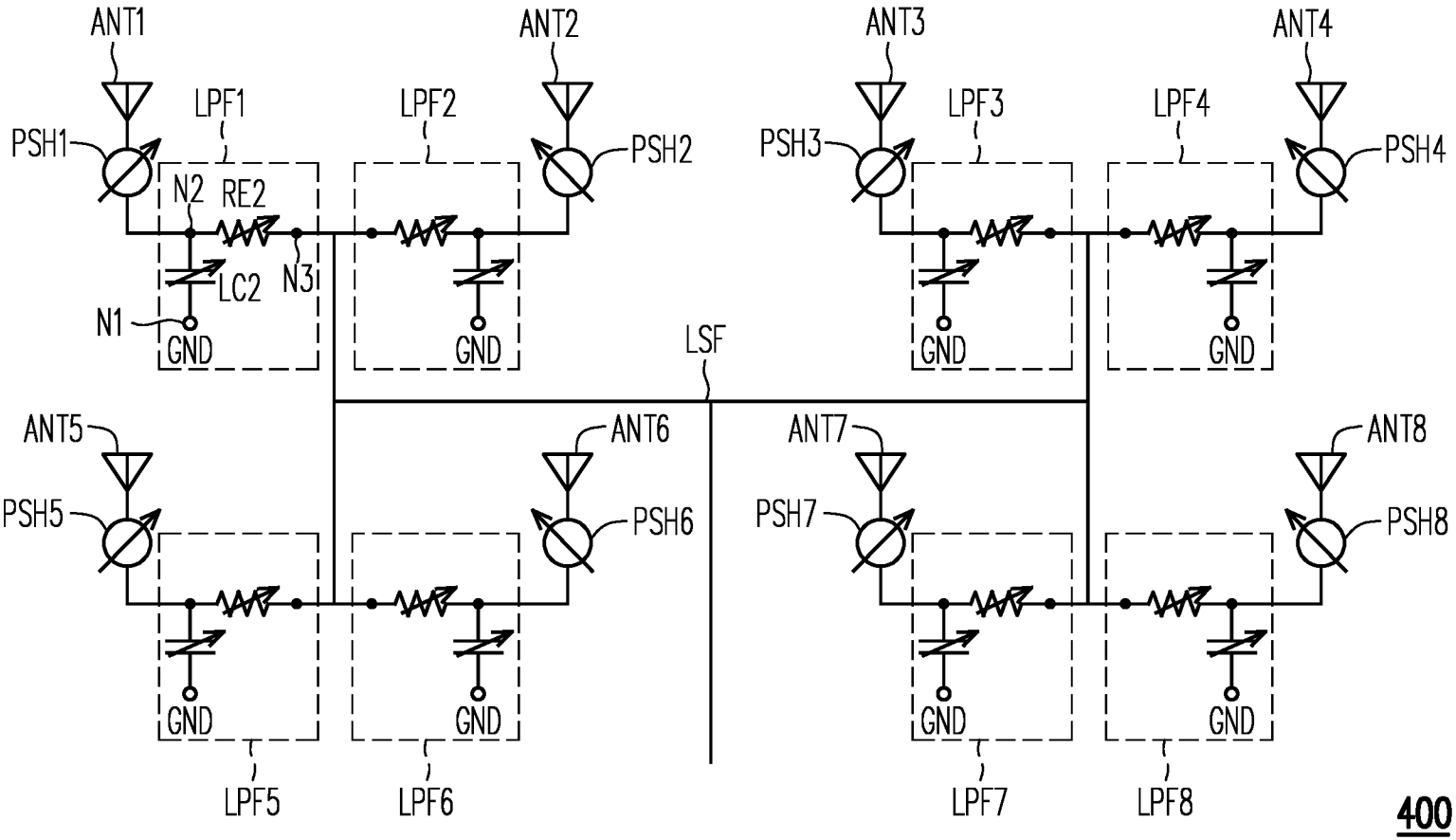
FIG. 4A is a schematic diagram of a system of an active phased array according to a fourth embodiment of the disclosure.

FIG. 4A is a schematic diagram of a system of an active phased array according to a fourth embodiment of the disclosure. Please refer to FIG. 1A and FIG. 4A. In the embodiment, an active phased array 400 is roughly the same as the active phased array 100. The differences are that low-pass filters LPF1 to LPF8 are used instead of the high-pass filters HPF1 to HPF8, and each of the low-pass filters LPF1 to LPF8 includes a filter capacitor LC2 and a filter resistor RE2. The same or similar reference numerals are used for similar or identical elements. In each of the low-pass filters LPF1 to LPF8, for the coupling manner of the filter capacitor LC2 and the filter resistor RE2, reference may be made to the filter capacitor LC1 and the filter resistor RE1. The differences are that the first node N1 is coupled to the ground GND, the second node N2 is coupled to a corresponding one of the phase shifters PSH1 to PSH8, and the third node N3 is coupled to the signal feeding line LSF.

In the embodiment, the first node N1 is coupled to the ground GND, the second node N2 is coupled to a corresponding one of the phase shifters PSH1 to PSH8, the third node N3 is coupled to the signal feeding line LSF, and at least one of the capacitance and the resistance is adjustable. As a result, the cut-off frequency of the low-pass filters LPF1 to LPF8 will move with the adjusted capacitance and/or resistance, so that the low-pass filters LPF1 to LPF8 are conducted or cut off relative to the carrier frequency of the antenna signal transmitted by the signal feeding line LSF.

Figure 4B:
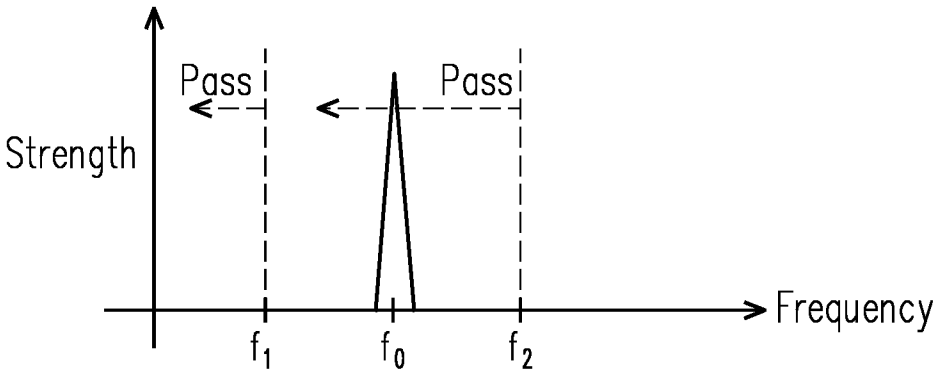
FIG. 4B is a schematic diagram of a frequency domain of a low-pass filter according to an embodiment of the disclosure.

FIG. 4B is a schematic diagram of a frequency domain of a low-pass filter according to an embodiment of the disclosure. Please refer to FIG. 4A and FIG. 4B. When setting the capacitance of the filter capacitor LC2 and the resistance of the filter resistor RE2 of each of the low-pass filters LPF1 to LPF8 such that the cut-off frequency (such as the cut-off frequency $f_2$) of each of the low-pass filters LPF1-LPF8 is higher than the carrier frequency $f_0$ of the antenna signal transmitted by the signal feeding line LSF, each of the low-pass filters LPF1-LPF8 is conducted relative to the carrier frequency $f_0$ of the antenna signal transmitted by the signal feeding line LSF. When setting the capacitance of the filter capacitor LC2 and/or the resistance of the filter resistor RE2 of each of the low-pass filters LPF1 to LPF8 such that the cut-off frequency (that is, the cut-off frequency $f_1$) of each of the high-pass filters HPF1 to HPF8 is lower than the carrier frequency $f_0$, each of the low-pass filters LPF1 to LPF8 is cut off relative to the carrier frequency $f_0$ of the antenna signal transmitted by the signal feeding line LSF.

Figure 5:
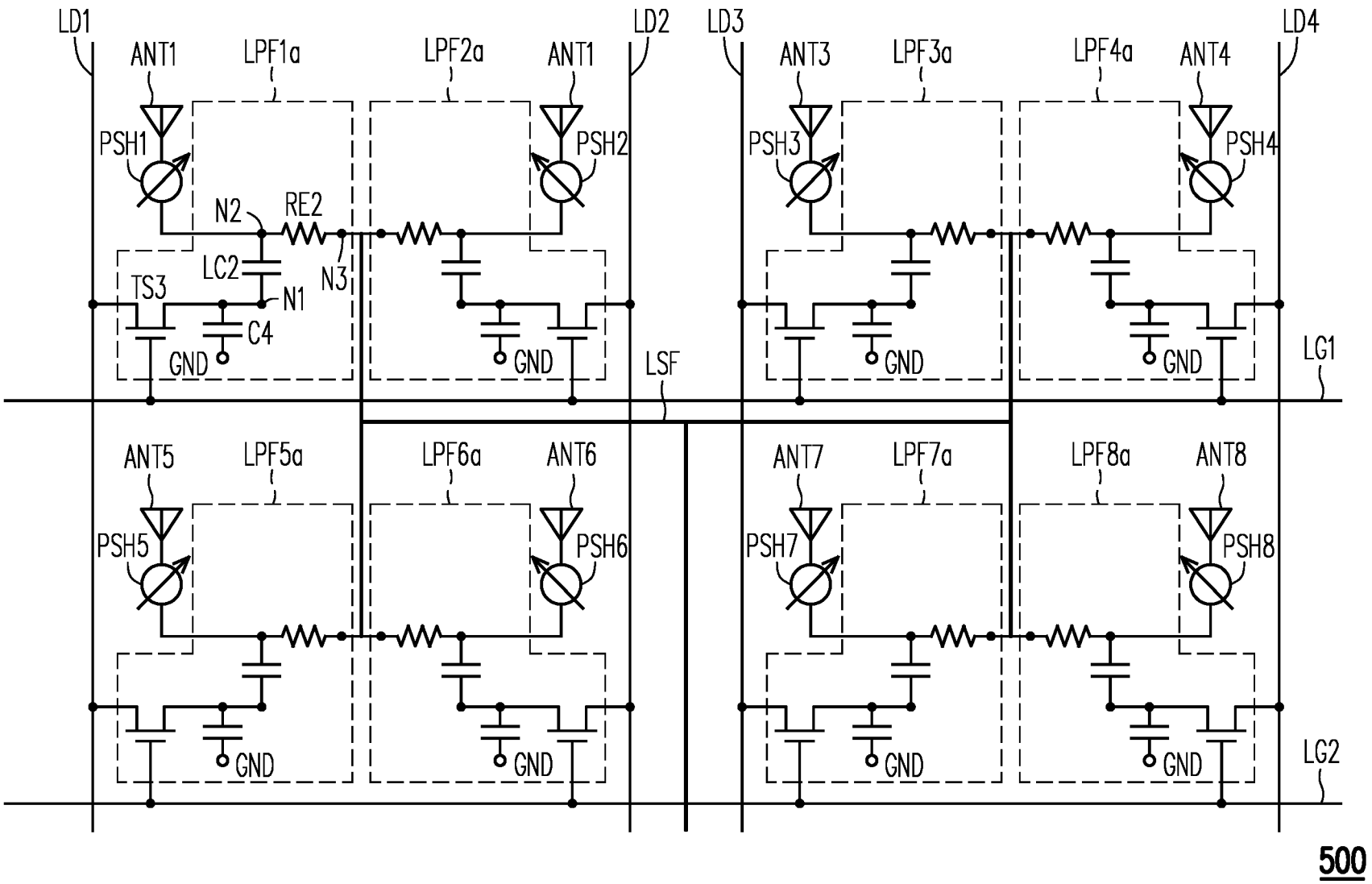
FIG. 5 is a schematic diagram of a system of an active phased array according to a fifth embodiment of the disclosure.

FIG. 5 is a schematic diagram of a system of an active phased array according to a fifth embodiment of the disclosure. Please refer to FIG. 4A and FIG. 5. In the embodiment, an active phased array 500 is roughly the same as the active phased array 100. The differences are with low-pass filters LPF1*a* to LPF8*a*, and that the active phased array 500 further includes multiple data lines (such as LD1 to LD4) and multiple gate lines (such as LG1 to LG2) to receive a signal and/or a voltage required for control. The same or similar reference numerals are used for similar or identical elements.

In the embodiment, it is assumed that the capacitance of the filter capacitor LC2 in each of the low-pass filters LPF1*a* to LPF8*a* is adjustable. Here, take the low-pass filter LPF1*a* as an example, and for the low-pass filters LPF2*a* to LPF8*a*, reference may be made to the low-pass filter LPF1*a*. In the embodiment, in addition to the filter capacitor LC2 and the filter resistor RE2, the low-pass filter LPF1*a* further includes a third switching transistor TS3 and a fourth capacitor C4. The third switching transistor TS3 has a first terminal coupled to the filter capacitor LC2, a second terminal coupled to the data line LD1, and a control terminal coupled to the gate line LG1. The fourth capacitor C4 is coupled between the first terminal of the third switching transistor TS3 and the ground GND.

According to the above, in each of the low-pass filters LPF1*a* to LPF8*a*, the voltage difference of the fourth capacitor C4 determines the capacitance of the filter capacitor LC2, and the third switching transistor TS3 of each of the low-pass filters LPF1*a* to LPF8*a* may be sequentially conducted via signals of the gate lines LG1 to LG2 to sequentially set the voltage difference of the fourth capacitor C4 of each of the low-pass filters LPF1*a* to LPF8*a* via voltages on the data lines LD1 to LD4, so as to change the capacitance of the filter capacitor LC2 of each of the low-pass filters LPF1*a* to LPF8*a*.

Figure 6:
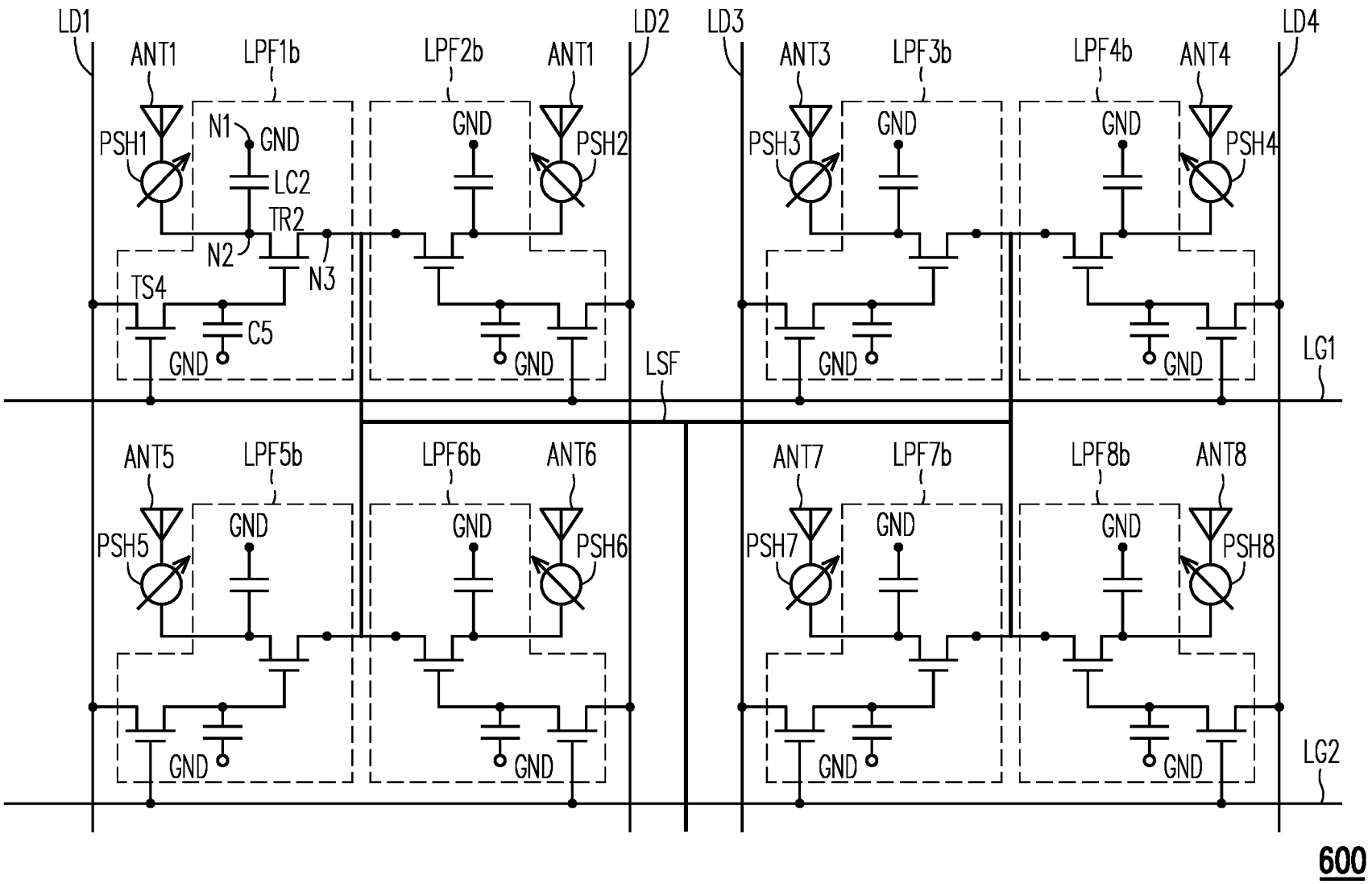
FIG. 6 is a schematic diagram of a system of an active phased array according to a sixth embodiment of the disclosure.

FIG. 6 is a schematic diagram of a system of an active phased array according to a sixth embodiment of the disclosure. Please refer to FIG. 4A and FIG. 6. In the embodiment, an active phased array 600 is roughly the same as the active phased array 400. The differences are with low-pass filters LPF1*b* to LPF8*b*, and that the active phased array 600 further includes multiple data lines (such as LD1 to LD4) and multiple gate lines (such as LG1 to LG2) to receive a signal and/or a voltage required for control. The same or similar reference numerals are used for similar or identical elements.

In the embodiment, it is assumed that the resistance of the filter resistor RE2 in the low-pass filters LPF1*b* to LPF8*b* is adjustable. Here, take the low-pass filter LPF1*b* as an example, and for the low-pass filters LPF2*b* to LPF8*b*, reference may be made to the low-pass filter LPF1*b*. In the embodiment, the filter resistor RE2 includes an impedance transistor TR2. The impedance transistor TR2 has a first terminal coupled to the signal feeding line LSF, a second terminal coupled to the phase shifter PSH1, and a control terminal. In addition, the second node N2 is coupled between the filter capacitor LC2, the second terminal of the impedance transistor TR2, and the phase shifter PSH1.

Moreover, in addition to the filter capacitor LC2 and the impedance transistor TR2, the low-pass filter LPF1*b* further includes a fourth switching transistor TS4 and a fifth capacitor C5. The fourth switching transistor TS4 has a first terminal coupled to the control terminal of the impedance transistor TR2, a second terminal coupled to the data line LD1, and a control terminal coupled to the gate line LG1. The fifth capacitor C5 is coupled between the first terminal of the fourth switching transistor TS4 and the ground GND.

According to the above, in each of the low-pass filters LPF1*b* to LPF8*b*, the voltage difference of the fifth capacitor C5 determines the resistance of the filter resistor RE2, and the fourth switching transistor TS4 of each of the low-pass filters LPF1*b* to LPF8*b* may be sequentially conducted via signals of the gate lines LG1 to GL2 to set the voltage difference of the fifth capacitor C5 of each of the low-pass filters LPF1*b* to LPF8*b* via voltages on the data lines LD1 to LD4, so as to change the resistance of the filter resistor RE2 of each of the low-pass filters LPF1*b* to LPF8*b*.

In summary, in the active phased array of the embodiments of the disclosure, the filter is composed of the filter capacitor and the filter resistor, and at least one of the capacitance of the filter capacitor and the resistance of the filter resistor is adjustable. In this way, the cut-off frequency of the filter will move with the adjusted capacitance and/or resistance, so that the filter is conducted or cut off relative to the carrier frequency of the antenna signal transmitted by the signal feeding line.

Although the disclosure has been disclosed in the above embodiments, the embodiments are not intended to limit the disclosure. Persons skilled in the art may make some changes and modifications without departing from the spirit and scope of the disclosure. The protection scope of the disclosure shall be defined by the appended claims.

What is claimed is:

1. An active phased array, comprising:

a plurality of antennas;

a plurality of phase shifters, individually coupled to a corresponding one of the antennas; and a plurality of filters, commonly coupled to a signal feeding line and individually coupled to a corresponding one of the phase shifters, wherein each of the filters has an adjustable cut-off frequency and each of the filters comprises:

a filter capacitor, coupled between a first node and a second node and having a capacitance; and a filter resistor, coupled between the second node and a third node and having a resistance, wherein at least one of the capacitance and the resistance is adjustable, wherein each of the filters is a high-pass filter, wherein the first node is coupled to the signal feeding line, the second node is coupled to a corresponding one of the phase shifters, and the third node is coupled to the ground, wherein when the capacitance is adjustable, the filter capacitor comprises a liquid crystal capacitor, and each of the filters further comprises:

a first capacitor, coupled between the signal feeding line and the filter capacitor;

a first switching transistor, having a first terminal coupled to the filter capacitor, a second terminal coupled to a data line, and a control terminal coupled to a gate line; and a second capacitor, coupled between the first terminal of the first switching transistor and the ground.

2. The active phased array according to claim 1, wherein when a cut-off frequency of each of the filters is lower than a carrier frequency of an antenna signal transmitted by the signal feeding line, each of the filters is conducted, and when the cut-off frequency of each of the filters is higher than the carrier frequency, each of the filters is cut off.

3. An active phased array, comprising:

a plurality of antennas;

a plurality of phase shifters, individually coupled to a corresponding one of the antennas; and a plurality of filters, commonly coupled to a signal feeding line and individually coupled to a corresponding one of the phase shifters, wherein each of the filters has an adjustable cut-off frequency and each of the filters comprises:

a filter capacitor, coupled between a first node and a second node and having a capacitance; and a filter resistor, coupled between the second node and a third node and having a resistance, wherein at least one of the capacitance and the resistance is adjustable, wherein each of the filters is a high-pass filter, wherein the first node is coupled to the signal feeding line, the second node is coupled to a corresponding one of the phase shifters, and the third node is coupled to the ground, wherein when the resistance is adjustable, the filter resistor comprises an impedance transistor, the impedance transistor has a first terminal coupled to a corresponding one of the phase shifters, a second terminal coupled to the ground, and a control terminal, wherein each of the filters further comprises:

a second switching transistor, having a first terminal coupled to the control terminal of the impedance transistor, a second terminal coupled to a data line, and a control terminal coupled to a gate line; and a third capacitor, coupled between the first terminal of the second switching transistor and the ground.

4. An active phased array, comprising:

a plurality of antennas;

a plurality of phase shifters, individually coupled to a corresponding one of the antennas; and a plurality of filters, commonly coupled to a signal feeding line and individually coupled to a corresponding one of the phase shifters, wherein each of the filters has an adjustable cut-off frequency and each of the filters comprises:

a filter capacitor, coupled between a first node and a second node and having a capacitance; and a filter resistor, coupled between the second node and a third node and having a resistance, wherein at least one of the capacitance and the resistance is adjustable, wherein each of the filters is a low-pass filter, wherein the first node is coupled to the ground, the second node is coupled to a corresponding one of the phase shifters, and the third node is coupled to the signal feeding line, wherein when the capacitance is adjustable, the filter capacitor comprises a liquid crystal capacitor, and each of the filters further comprises:

a third switching transistor, having a first terminal coupled to the filter capacitor, a second terminal coupled to a data line, and a control terminal coupled to a gate line; and a fourth capacitor, coupled between the first terminal of the third switching transistor and the ground.

5. The active phased array according to claim 4, wherein when a cut-off frequency of each of the filters is higher than a carrier frequency of an antenna signal transmitted by the signal feeding line, each of the filters is conducted, and when the cut-off frequency of each of the filters is lower than the carrier frequency, each of the filters is cut off.

6. An active phased array, comprising:

a plurality of antennas;

a plurality of phase shifters, individually coupled to a corresponding one of the antennas; and a plurality of filters, commonly coupled to a signal feeding line and individually coupled to a corresponding one of the phase shifters, wherein each of the filters has an adjustable cut-off frequency and each of the filters comprises:

a filter capacitor, coupled between a first node and a second node and having a capacitance; and a filter resistor, coupled between the second node and a third node and having a resistance, wherein at least one of the capacitance and the resistance is adjustable, wherein each of the filters is a low-pass filter, wherein the first node is coupled to the ground, the second node is coupled to a corresponding one of the phase shifters, and the third node is coupled to the signal feeding line, wherein when the resistance is adjustable, the filter resistor comprises an impedance transistor, the impedance transistor has a first terminal coupled to the signal feeding line, a second terminal coupled to a corresponding one of the phase shifters, and a control terminal, wherein each of the filters further comprises:

a fourth switching transistor, having a first terminal coupled to the control terminal of the impedance transistor, a second terminal coupled to a data line, and a control terminal coupled to a gate line; and a fifth capacitor, coupled between the first terminal of the fourth switching transistor and the ground.

* * * * *